US005104324A

United States Patent [19]

Grabbe et al.

[11] Patent Number: 5,104,324

[45] Date of Patent: Apr. 14, 1992

[54] MULTICHIP MODULE CONNECTOR

[75] Inventors: Dimitry G. Grabbe, Middletown; Iosif Korsunsky, Harrisburg, both of Pa.

[73] Assignee: AMP Incorporated, Harrisburg, Pa.

[21] Appl. No.: 721,053

[22] Filed: Jun. 26, 1991

[51] Int. Cl.[5] ..... H01R 9/09

[52] U.S. Cl. ..... 439/62; 439/83; 439/632; 439/876

[58] Field of Search ..... 439/62, 65, 72, 76, 439/81, 83, 629, 630, 632, 876

[56] References Cited

U.S. PATENT DOCUMENTS

| | | | |
|---|---|---|---|
| 4,586,764 | 5/1986 | Mullen, III et al. | 439/83 |
| 4,598,972 | 7/1986 | Mullen, III et al. | 439/876 |
| 4,891,023 | 1/1990 | Lopata | 439/62 |
| 5,002,494 | 3/1991 | Olsson | 439/632 |

*Primary Examiner*—Paula A. Bradley
*Attorney, Agent, or Firm*—Allan B. Osborne

[57] ABSTRACT

A connector (80) for electrically interconnecting a semi-conductor device (92) to a substrate (86) is disclosed. The connector (80) includes a housing (50) having parallel channels (64) for receiving the devices (92) and contact elements (10) with cantilevered spring arms (18) for electrically engaging the devices (92) and a base (12) having an edge (26) for electrically engaging a circuit (84) on the substrate (86).

16 Claims, 5 Drawing Sheets

MULTICHIP MODULE CONNECTOR

FIELD OF THE INVENTION

The invention disclosed herein relates to a connector for electrically interconnecting several semi-conductor devices to a substrate.

BACKGROUND OF THE INVENTION

The use of multichip modules has the advantage of higher speeds relative to conventionally packaged semi-conductor devices and the associated capacitive loading which long connections create. However, if the length of interconnections between semi-conductor devices can be substantially shortened, a significant improvement in speed over the multichip modules would be obtainable. If then, all input and output terminals or contact pads can be placed along one edge of a device, a connector can be designed which would permit stacking the devices therein in an extremely tight spacing. Further, since certain devices require a relatively small number I/O and power and ground terminals or pads, and a majority can be bussed, the mechanics for building such a connector can be greatly simplified without sacrificing mechanical integrity and strength. Because manufacturers of semi-conductive devices have indicated the ability to place pads along one edge, it is now proposed to provide a connector for interconnecting several semi-conductor devices to a substrate.

SUMMARY OF THE INVENTION

According to the present invention, a connector for electrically interconnecting a semi-conductor device to a substrate is provided which comprises a housing having parallel channels for receiving the devices and contact elements with spring arms in the channels for electrically engaging the devices and a base having an edge for electrically engaging a circuit on the substrate.

DESCRIPTION OF THE INVENTION

Figure 1:
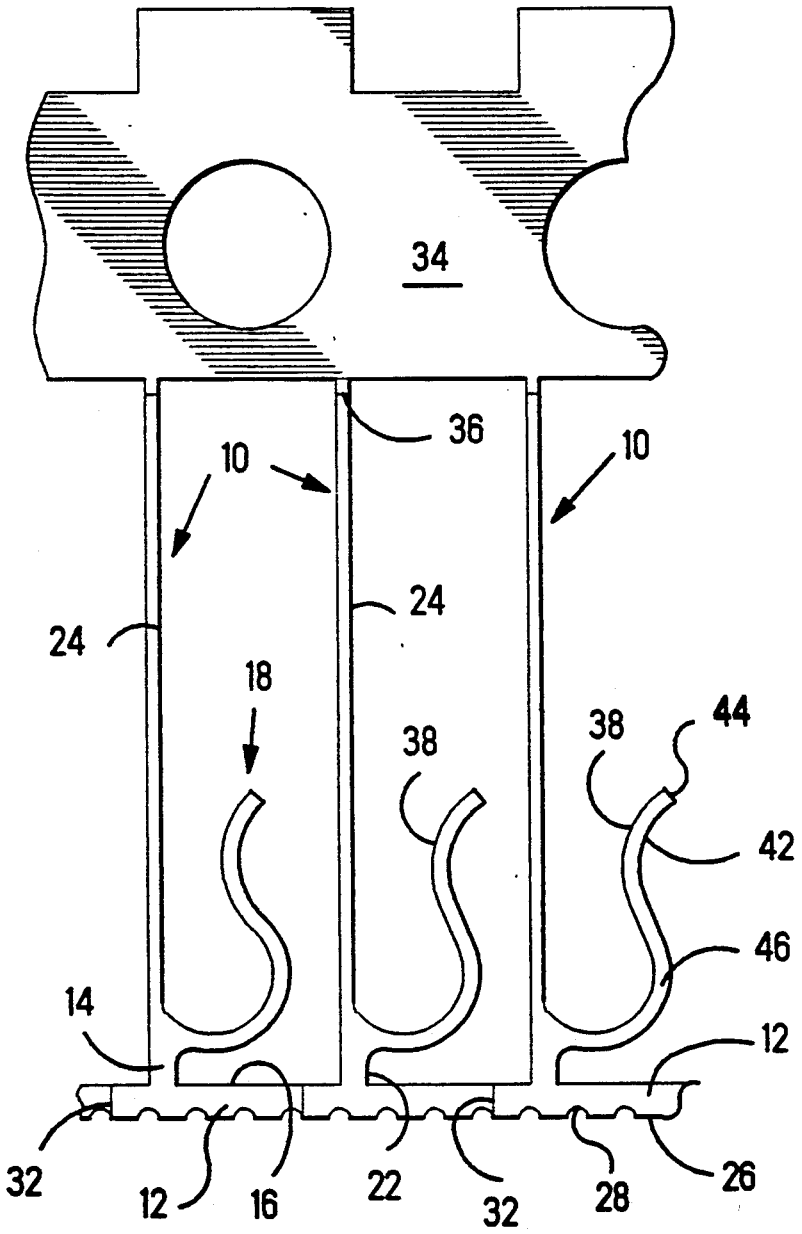
FIG. 1 is a side view of a strip of contact elements according to the present invention.

With reference to FIG. 1, contact elements 10 include base 12, strap 14 attached to top edge 16 of base 12, a cantilevered spring arm 18 attached to side edge 22 of strap 14 and stabilizing bar 24 extending outwardly from an end of strap 14. Bottom edge 26 of base 12 may be scalloped as indicated by reference numeral 28. As shown, base 12 is continuous along the strip of elements 10 with scribe lines 32 provided to enable elements 10 to be separated as required. Each bar 24 is attached to carrier strip 34 and is also provided with a scribe line 36.

Spring arms 18 are S-shaped with a contact surface 38 provided on one S-curve 42 adjacent the arm's free end 44. The second S-curve 46 is between curve 42 and strap 14.

Contact elements 10 are preferably stamped and formed from flat stock (not shown) with a suitable material being beryllium copper for example.

Figure 2:
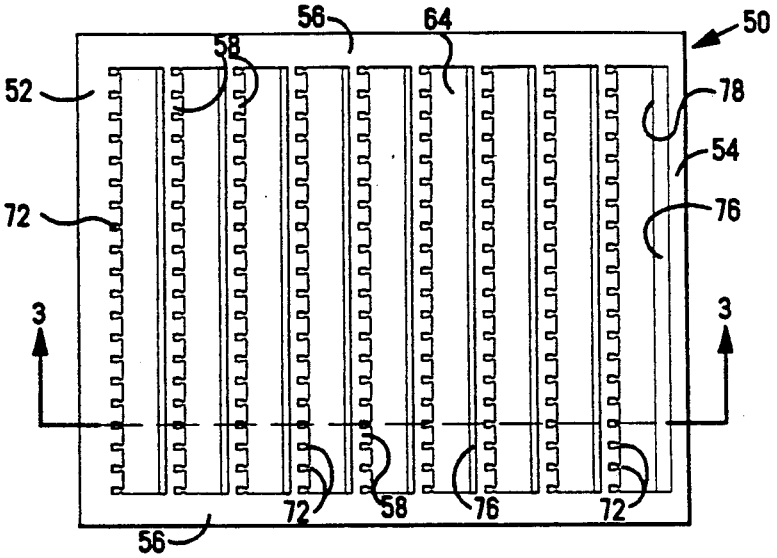
FIGS. 2, 3 and 4 are top, side and bottom views of a housing according to the present invention.
Figure 3:
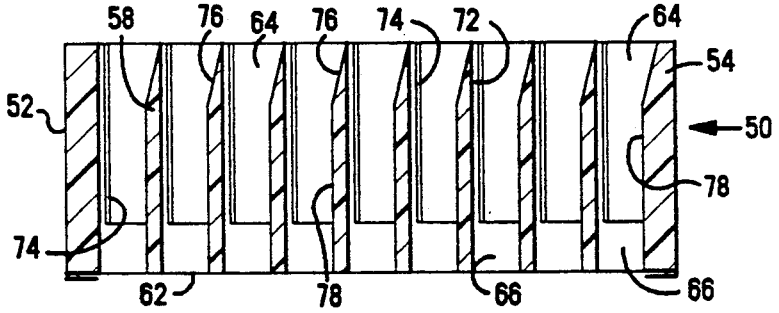
Figure 4:
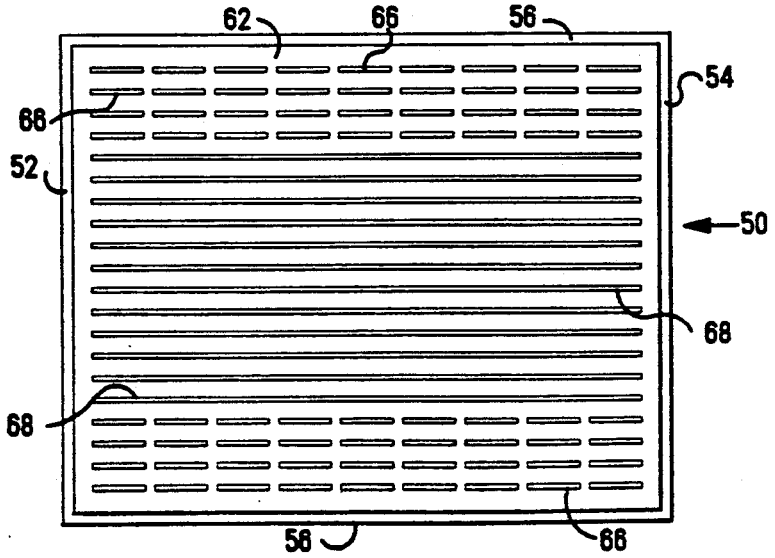

FIGS. 2, 3 and 4 are top plan, sectioned side and bottom plan views of housing 50 of the present invention.

Considering FIGS. 2 and 3, housing 50, molded from a suitable plastics material such as a liquid crystal polymer, includes end walls 52, 54, side walls 56 and interior walls 58 which are parallel to end walls 52, 54. Further, housing 50 includes base 62 which defines, in cooperation with all the aforementioned walls 52–58, several channels 64. As shown, channels 64 are parallel with the end walls 52, 54 and interior walls 58.

As shown in FIG. 4, slots 66, 68 cut through base 62 to communicate with respective channels 64. Slots 66 cut through base 62 in alignment with respective channels 64. Slots 68, on the other hand, cut through base 62 from end wall 52–54 to end wall 54–52. Both slots 66, 68 parallel side walls 56.

T-shaped recesses 72 are provided in surfaces 74 of end walls 52 and interior walls 58 and face into channels 64. These recesses 72 are in communications with slots 66, 68 as shown in FIG. 3.

Ramps 76 are provided on surfaces 78 of end wall 54 and interior walls 58. As shown in FIG. 3, ramps 76 are at the tops of surfaces 78.

Figure 5:
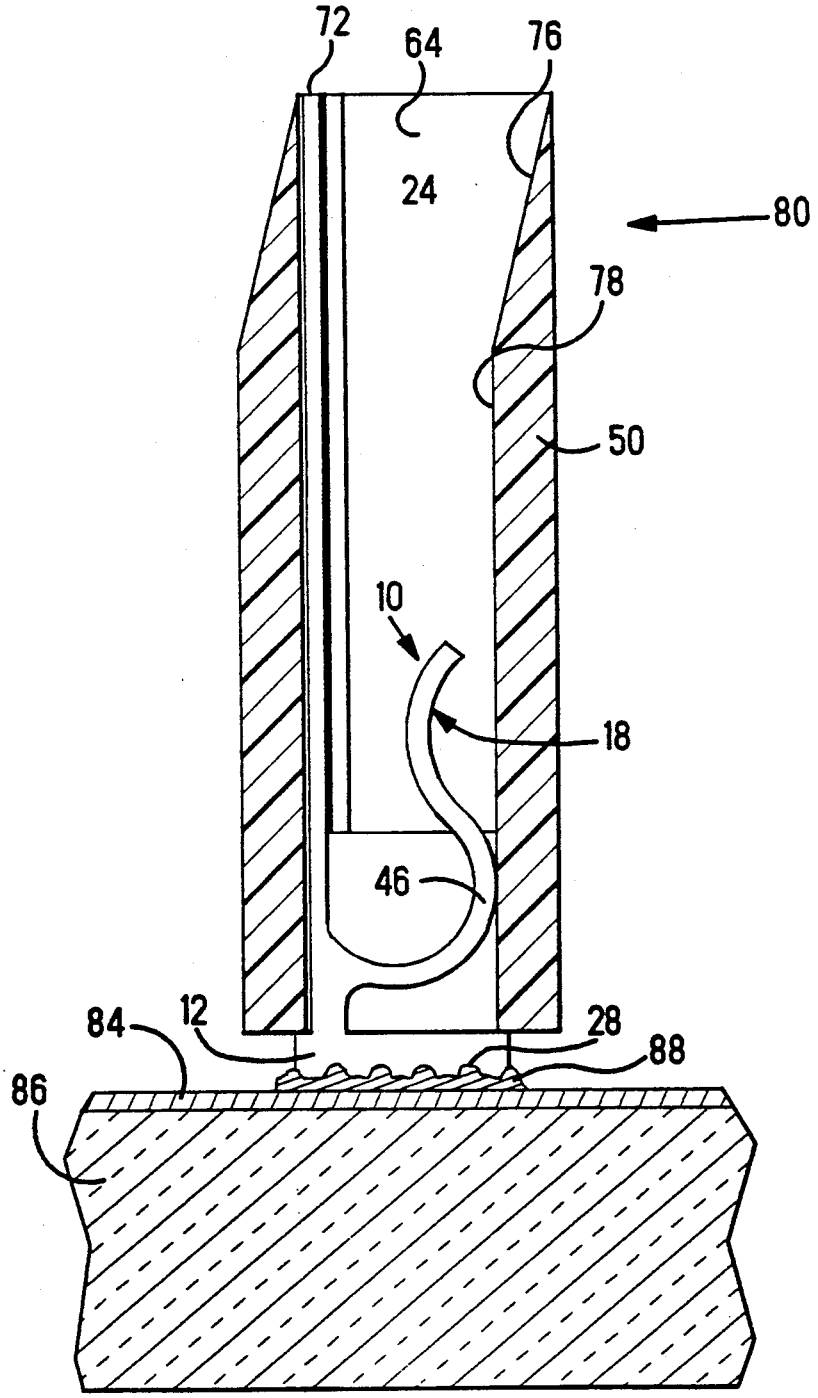
FIG. 5 is a sectioned side view of a portion of a connector of the present invention.

FIG. 5 shows a portion of connector 80 of the present invention; i.e., an end view of one channel 64 of housing 50 with a contact element 10 in place therein. Further, the drawing shows element 10 soldered to a conductive circuit 84 on substrate 86.

Contact element 10 is loaded into channel 64 through slot 66. Stabilizing bar 24 is received in T-shaped recess 72 and spring arm 18 extends up into channel 64 with S-curve 46 bearing against or right next to surface 78 of an interior wall 58 (or end wall 54). Base 12 of element 10 extends below housing 50 and is electrically and mechanically secured to circuit 84 by solder 88. As shown, solder 88 fills scallops 28 so that within each scallop, there is a substantially thicker layer of solder which is capable of absorbing more deformation before fracturing.

Slots 68 receive a continuous strip of contact elements 10 for those cases where I/O or power or ground pads on semi-conductor devices (not shown) inserted into connector 80 can be commoned or bussed.

Figure 6:
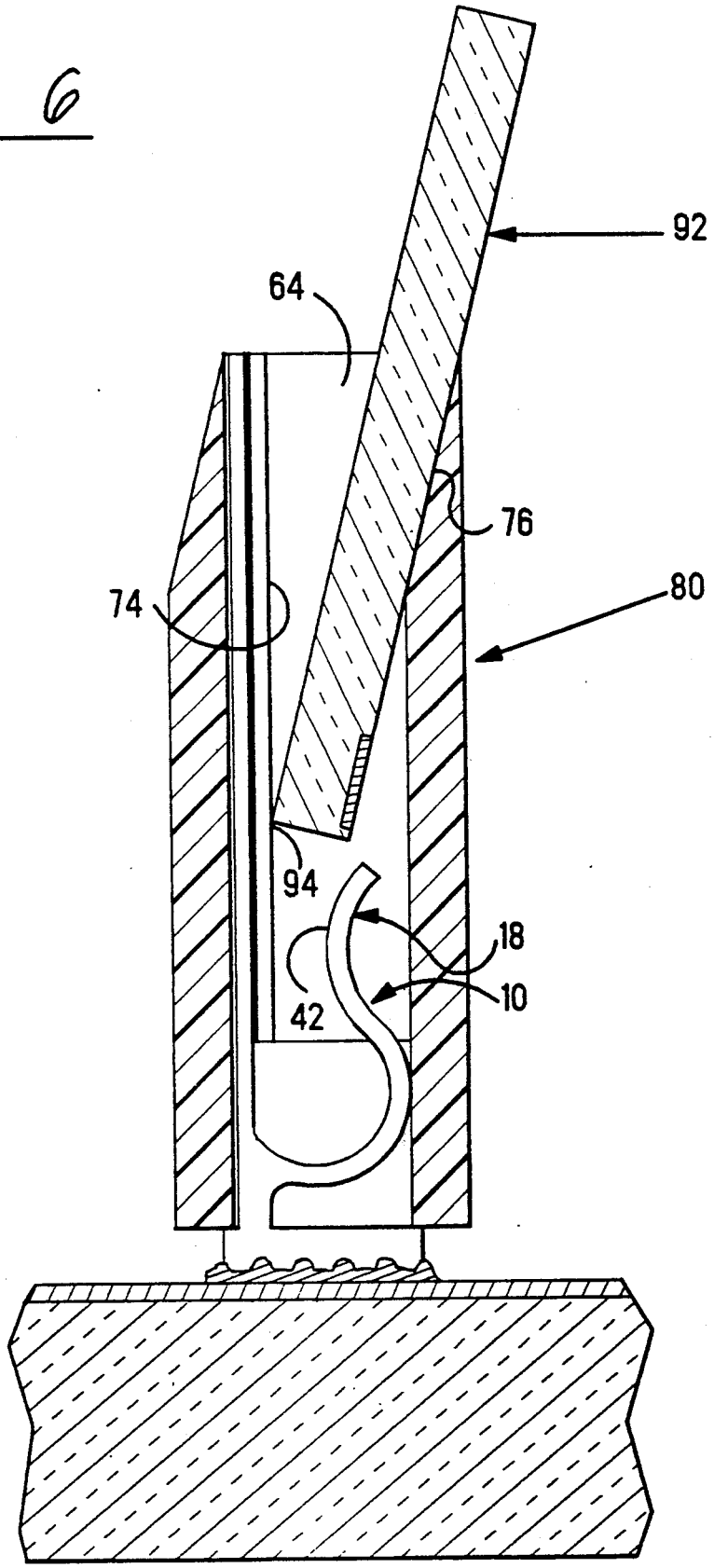
FIGS. 6 and 7 are sectioned side views of a portion of the connector showing the insertion of a semi-conductor device.

FIG. 6 shows the first step in inserting a semi-conductor device 92 into a channel 64. Device 92 is slid down into channel 64 on ramp 76 until corner 94 engages surface 74 of interior wall 58 on the opposite side of the channel 64. Device 92 continues to move down on ramp 76 and against surface 74 until spring arm 18 is slidingly engaged. It is to be noted that device 92 is approaching and will engage spring arm 18 on a tangent to S-curve 42. This results in a reduction in insertion force and practically eliminates stubbing. At that time, device 92 is rotated to a vertical position relative to connector 80 and pushed into its final position as shown in FIG. 7.

Figure 7:
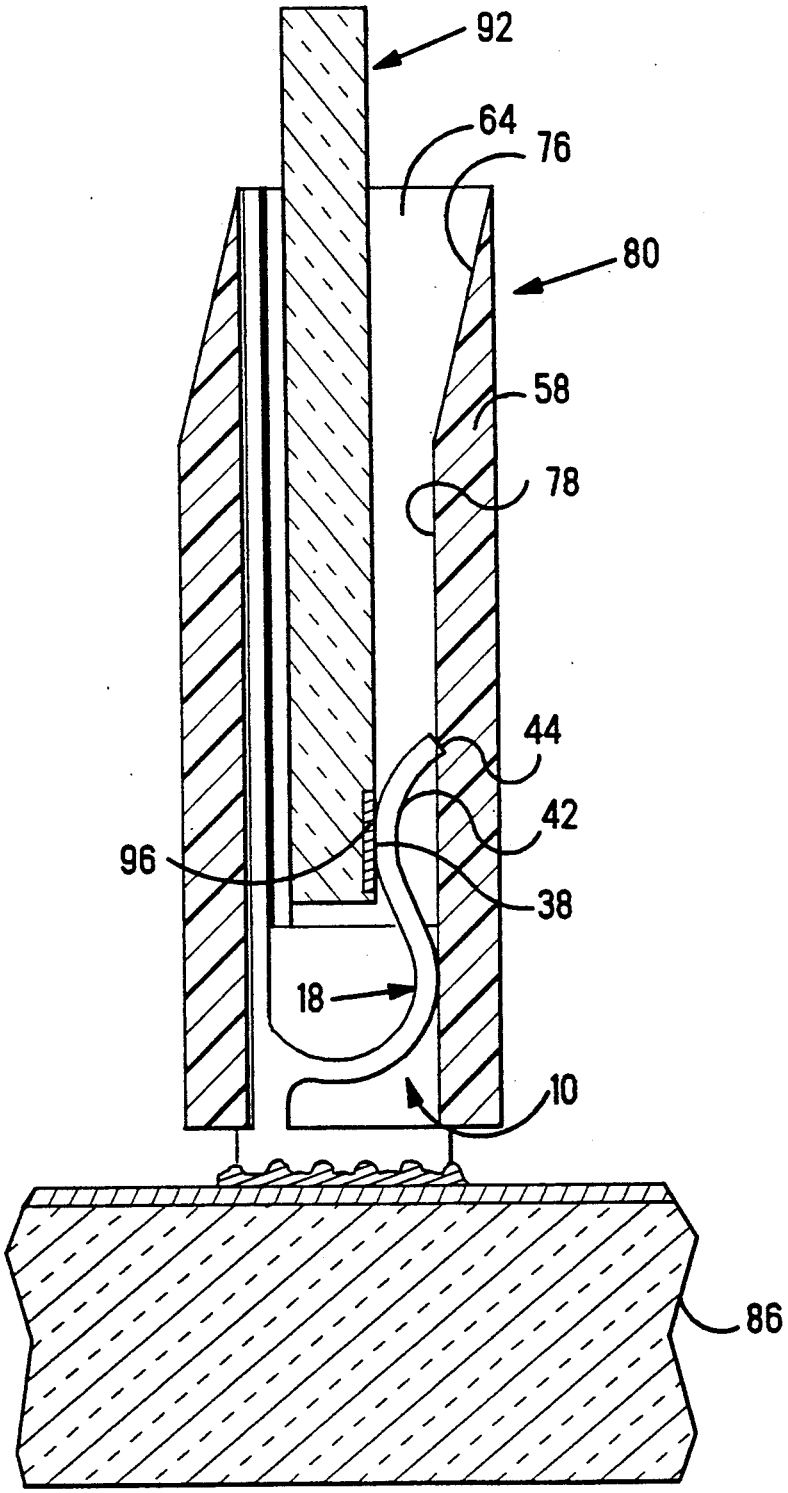

With reference to FIG. 7 spring arm 18 has been resiliently cammed towards surface 78 of wall 58 and, as shown, free end 44 may engage it to prevent arm 18 from being over-stressed. This resilient deformation provides the required normal force so that an excellent electrical contact is made and maintained between contact surface 38 and contact pad 96 on device 92. Further, since the engagement is made slidingly, wiping occurs which even more enhances the electrical contact.

As noted above, where pads on devices 92 in other channels can be bussed, a strip of contact elements 10, loaded in a slot 68, can be utilized.

The present invention has been developed to meet a need to interconnect semi-conductor devices to a substrate. However, it should be readily apparent that connector 80 can be used with other electronic devices (not shown). Also, spring arms 18 can be modified to extend further up in channel 64 to engage pads (not shown) elsewhere on device 92.

As can be discerned from the foregoing description, a connector for electrically interconnecting semi-conductor devices having pads along one edge to circuits on a substrate has been disclosed. The connector includes a housing having parallel channels in which contact elements having spring arms are disposed. The contact elements can be discrete or commoned with elements in adjacent channels to provide a bus. Semi-conductor devices inserted into the respective channels slidingly engage the spring arms for electrical connection therewith. The elements further include a scalloped edge which is soldered to circuits on a substrate.

We claim:

1. A connector for electrically interconnecting semi-conductor devices to a substrate, comprising:

a housing having parallel channels for receiving semi-conductor devices; and contact elements disposed in said channels and having spring arms for electrically engaging pads on semi-conductor devices and a base extending outwardly from said housing for electrically engaging circuits on a substrate and for being connected to other bases to form a bus.

2. The connector of claim 1 wherein adjacent said channels are separated by interior walls and with said interior walls having recesses perpendicular to the axis of said walls, and recesses adapted to receive a stabilizing bar extending outwardly from said base on said elements.

3. The connector of claim 1 wherein said spring arms are S-shaped and includes a contact surface on an S-curve for engaging pads on semi-conductor devices.

4. The connector of claim 3 wherein said contact elements are edge-stamped and formed.

5. A connector for electrically interconnecting semi-conductor devices to a substrate, comprising:

a housing having end walls, side walls, spaced interior walls parallel to said end walls and a base, said walls and base defining a plurality of channels extending between said side walls, said base providing a floor of said channels and stop means for semi-conductor devices which may be inserted into said channels and further having slots through said base intersecting respective channels; and contact elements of a conductive material disposed in said slots, each element having a base with one edge adapted to electrically engage a circuit on a substrate and a S-shaped spring arm extending from another edge of said element base into a respective chamber for engaging a pad on a semi-conductor device which may be inserted into said channel.

6. The connector of claim 5 wherein one surface of said interior walls facing respective channels include a ramp adjacent a free edge of said walls.

7. The connector of claim 5 wherein some of said slot intersect multiple channels.

8. The connector of claim 5 wherein said spring arm extends laterally from a strap extending outwardly from said another edge of said base.

9. A connector for electronic devices, comprising:

a housing having end walls, side walls, interior walls parallel to said end walls and a base, said walls and base defining electronic device-receiving channels separated by said interior walls, said base being provided with slots extending therethrough and communicating with a respective channel and opening out on a bottom surface of said housing and further, at least some of said end and interior walls are provided with recesses extending from said slots outwardly towards a free edge of said some walls; and a plurality of contact elements having a base with one edge adapted to electrically engage a circuit on a substrate and a strap extending outwardly from an opposite edge, a cantilevered spring arm attached to said strap and extending laterally therefrom in overlying registration with said element base and a stabilizing bar extending outwardly from said strap, said contact elements being positioned in respective slots with said one base edge extending outwardly from said housing and with said spring arm extending into a channel and with said stabilizing bar being received in a respective recess.

10. The connector of claim 9 wherein at least some of said end walls and interior walls are provided with a ramp on one surface, said ramps beginning at a free edge of said at least some walls so that an electronic device may be initially inserted into a said channel at an angle relative to walls and channels.

11. The connector of claim 9 wherein said recesses are T-shaped.

12. The connector of claim 9 wherein respective said contact elements in adjacent channels are electrically commoned to provide a bus for electronic devices which may be inserted in said adjacent channels.

13. The connector of claim 9 wherein said one edge on said element base is scalloped.

14. The connector of claim 9 wherein at least some of said slots are continuous from one end wall to another end wall.

15. The connector of claim 9 wherein said spring arms are S-shaped with one S-curve providing a contact surface for electrically engaging an electronic device which may be inserted into a respective said channel.

16. The connector of claim wherein a second S-curve abuts one of said walls defining said channels.

* * * * *